US009822550B2

(12) United States Patent
Fenwick

(10) Patent No.: US 9,822,550 B2
(45) Date of Patent: Nov. 21, 2017

(54) FLEXIBLE DOOR LATCH STRIKE

(71) Applicant: Roy Fenwick, Toronto (CA)

(72) Inventor: Roy Fenwick, Toronto (CA)

( * ) Notice: Subject to any disclaimer, the term of this patent is extended or adjusted under 35 U.S.C. 154(b) by 0 days.

(21) Appl. No.: 15/206,386

(22) Filed: Jul. 11, 2016

(65) Prior Publication Data

US 2017/0009486 A1 Jan. 12, 2017

Related U.S. Application Data

(60) Provisional application No. 62/190,330, filed on Jul. 9, 2015.

(51) Int. Cl.

| | |
|---|---|
| ***E05B 15/02*** | (2006.01) |
| ***E05B 17/00*** | (2006.01) |
| *E05B 15/00* | (2006.01) |
| *E05B 15/16* | (2006.01) |

(52) U.S. Cl.

CPC ..... *E05B 15/022* (2013.01); *E05B 17/007* (2013.01); *E05B 2015/1671* (2013.01); *Y10S 292/38* (2013.01)

(58) Field of Classification Search

CPC .... E05B 15/02; E05B 15/0205; E05B 15/021; E05B 15/022; E05B 15/0225; E05B 15/024; E05B 15/0245; E05B 15/025; E05B 15/0255; E05B 15/029; E05B 15/16; E05B 15/1635; E05B 17/007; E05B 2015/1671; Y10T 292/68; Y10T 292/683; Y10T 292/685; Y10T 292/688; Y10T 292/691; Y10T 292/694; Y10T 292/696; Y10T 292/699; Y10T 292/702; Y10T 292/705; Y10T 292/707; Y10S 292/38; Y10S 292/57

USPC ..... 292/341.18, 341.19, 340, 341, 341.11, 292/341.12, 341.13, 341.14, 341.15, 292/341.16, 341.17, DIG. 38, DIG. 57

See application file for complete search history.

(56) References Cited

U.S. PATENT DOCUMENTS

| | | | | |
|---|---|---|---|---|
| 47,741 A * | 5/1865 | Morris | ..... | E05B 17/007 292/341.11 |
| 151,359 A * | 5/1874 | Davies | ..... | E05B 17/0045 16/86 A |
| 201,572 A * | 3/1878 | Taylor | ..... | E05B 17/007 292/341.11 |
| 213,967 A * | 4/1879 | Blackwood | ..... | E05B 17/007 292/341.11 |
| 539,969 A * | 5/1895 | Wells | ..... | E05B 17/007 292/341.11 |

(Continued)

FOREIGN PATENT DOCUMENTS

| | | | | |
|---|---|---|---|---|
| DE | 2263702 A1 * | 7/1974 | ..... | E05B 15/0205 |
| DE | 10216718 A1 * | 10/2003 | ..... | E05B 15/0205 |

(Continued)

OTHER PUBLICATIONS

DupontTM Delrin® Acetal Homopolymer (White Paper), How to Maximize the Property Advantages of Delrin® Acetal Homopolymer over Acetal Copolymer. pp. 1-15, 2015.

*Primary Examiner* — Carlos Lugo
(74) *Attorney, Agent, or Firm* — Bereskin & Parr LLP/S.E.N.C.R.L., s.r.l.; Michael Fenwick

(57) ABSTRACT

A door strike which includes a base plate, and a strike tongue, wherein the strike tongue comprises a flexible material.

15 Claims, 2 Drawing Sheets

(56) References Cited

U.S. PATENT DOCUMENTS 839,556 A * 12/1906 Cuff ..... E05B 15/0245 292/341.18
851,109 A * 4/1907 Swift ..... E05B 15/0205 292/341.11
852,553 A * 5/1907 Georgenson et al. ..... E05B 15/0245 292/341.19
1,194,636 A * 8/1916 Joy ..... E05B 17/08 292/137
1,194,637 A * 8/1916 Joy ..... E05B 17/007 292/341.11
1,295,458 A * 2/1919 Erffmeyer ..... E05B 15/0245 292/341.19
1,495,371 A * 5/1924 Witten ..... E05B 15/022 292/238
1,497,044 A * 6/1924 Terrell ..... E05B 17/007 292/163
1,563,667 A * 12/1925 Smith ..... E05B 15/025 292/341.18
1,663,300 A * 3/1928 Halper ..... E05B 63/244 292/341.17
1,723,305 A * 8/1929 Sipe ..... E05C 19/002 16/86 A
1,886,494 A * 11/1932 Mitchell ..... E05B 15/0225 16/86 B
1,913,444 A * 6/1933 Herdeg ..... E05B 15/025 292/341.18
2,350,635 A * 6/1944 Pendleton ..... E05B 15/0245 292/341.18
2,370,781 A * 3/1945 Cullum ..... E05B 17/2003 292/341.18
2,535,444 A * 12/1950 Miller ..... E05B 15/0255 292/341.13
2,713,506 A * 7/1955 Wickstrom ..... E05B 15/0245 244/7 R
2,899,227 A * 8/1959 Gschwend ..... E05C 1/12 292/163
2,946,614 A * 7/1960 Russell ..... E05B 15/0205 292/341.11
2,993,719 A * 7/1961 Manchester ..... E05B 15/0255 292/341.18
3,057,053 A * 10/1962 Schlage ..... E04F 21/003 29/407.1
3,161,429 A * 12/1964 Tornoe ..... E05B 15/025 292/341.18
3,241,873 A * 3/1966 Russell ..... E05B 15/0205 292/340
3,257,139 A * 6/1966 Russell ..... E05B 15/0245 292/341.18
3,601,078 A * 8/1971 Bedford ..... B63B 39/061 114/271
3,610,668 A * 10/1971 Tixier ..... E05B 85/24 292/341.12
3,801,143 A * 4/1974 Gutner ..... E05C 19/06 292/76
3,825,289 A * 7/1974 Armstrong ..... E05B 15/0205 292/163
3,966,248 A * 6/1976 James ..... E05B 15/0205 292/340
4,105,235 A * 8/1978 Thiel ..... E05B 15/0245 292/341.18
4,181,338 A * 1/1980 Sterling ..... E05B 15/022 292/341.17
4,288,120 A * 9/1981 Moore ..... E05B 15/025 292/341.18
4,429,495 A * 2/1984 Aoki ..... E05B 15/0225 292/341.11
4,466,645 A * 8/1984 Kobayashi ..... E05B 85/045 292/216
4,665,596 A * 5/1987 Green ..... A44B 11/125 220/283
4,813,724 A * 3/1989 Dietrich ..... E05B 15/022 292/341.12
4,892,341 A * 1/1990 Dietrich ..... E05B 15/022 292/341.12
4,893,854 A * 1/1990 Dietrich ..... E05B 15/022 292/341.12
4,991,888 A * 2/1991 Cinnamond ..... E05C 19/18 292/288
5,028,083 A * 7/1991 Mischenko ..... E05C 1/10 248/222.12
5,031,943 A * 7/1991 Scott ..... B65D 63/1081 24/16 PB
5,094,489 A * 3/1992 Jones ..... E05B 15/0205 292/340
5,897,147 A * 4/1999 Alyanakian ..... E05B 17/0004 292/153
5,974,842 A * 11/1999 Schlack ..... E05B 17/0004 292/153
5,975,593 A * 11/1999 Cress ..... E05B 53/001 292/101
6,637,096 B2 * 10/2003 Kang ..... E05B 15/0205 29/11
6,857,672 B1 * 2/2005 Drew, II ..... E05B 15/0205 292/340
7,686,356 B2 * 3/2010 Wilder ..... E05B 15/022 292/340
8,491,020 B2 * 7/2013 Lopes ..... B60D 1/60 292/1
2002/0008391 A1 * 1/2002 Patton ..... E05C 19/06 292/341.17
2006/0202486 A1 * 9/2006 Graute ..... E05B 77/38 292/216
2007/0040397 A1 * 2/2007 Nicholas ..... E05B 15/0245 292/341.18
2016/0177611 A1 * 6/2016 Rissone ..... E05F 5/02 267/139

FOREIGN PATENT DOCUMENTS

EP EP 1113127 A1 * 7/2001 ..... E05B 15/022
EP EP 1703043 A2 * 9/2006 ..... E05B 15/0205
FR 605232 A * 5/1926 ..... E05B 15/022
FR 2355978 A1 * 1/1978 ..... E05B 15/0225
GB 190905762 A * 0/1909 ..... E05B 15/0205
GB 2472271 A * 2/2011 ..... E05B 15/0205

* cited by examiner

FLEXIBLE DOOR LATCH STRIKE

FIELD

The present disclosure relates to a door strike. In particular, the disclosure relates to a flexible door latch strike comprising a base plate and a strike tongue, wherein the strike tongue comprises a flexible material.

INTRODUCTION

A conventional door lock latch is mounted on a door and is cooperatively received within a door latch strike mounted on the door jamb. A typical door latch strike is a stamped metal member having a suitable aperture for receiving the latch, which stamped metal member is secured to the door jamb by passing a pair of screws through a pair of openings—one above the latch opening and one below the latch opening—and passing the screws into the door jamb. The latch aperture on the stamped metal member overlies a similar aperture located on the door jamb. When the door is being closed, the latch is received within the aperture on the stamped metal member and the opening on the door jamb there behind, guided there by a tongue which faces toward the door when opened.

SUMMARY

The present disclosure relates to a door latch strike, also known as a strike plate, specifically a flexible door latch strike. In one embodiment, the flexible door latch strike is for attachment to a door jamb. In one embodiment, the flexible door latch strike comprises a base plate and a strike tongue, wherein the strike tongue comprises a flexible material. The present disclosure therefore relates to a door strike, comprising:

a) a base plate having an aperture for receiving a door latch, the base plate adapted to be attached to a door jamb; and b) a strike tongue extending outwardly from the base plate and adapted to guide the door latch to the aperture, wherein the strike tongue comprises a flexible material.

Other features and advantages of the present application will become apparent from the following detailed description. It should be understood, however, that the detailed description and the specific examples while indicating preferred embodiments of the application are given by way of illustration only, since various changes and modifications within the spirit and scope of the application will become apparent to those skilled in the art from this detailed description.

DRAWINGS

The disclosure will now be described in greater detail with reference to the following drawings in which.

DESCRIPTION OF VARIOUS EMBODIMENTS

(I) Definitions

Figure 1:
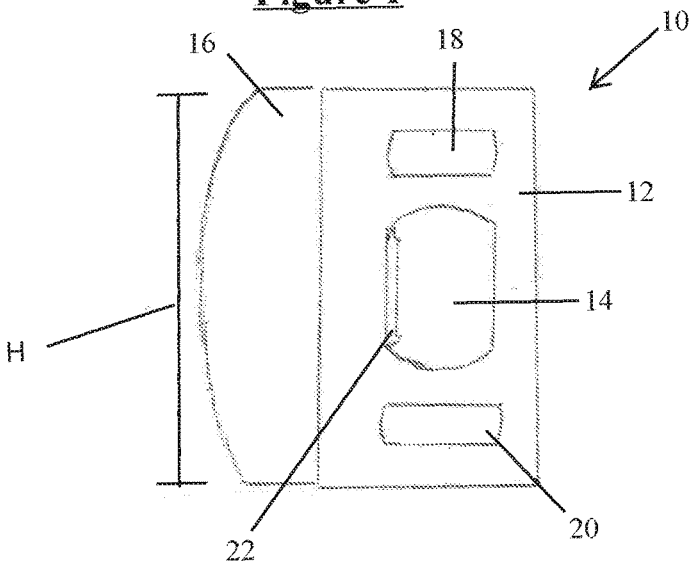
FIG. 1 is a front elevation view of a door strike in one embodiment of the disclosure.

The term "strike tongue" as used herein refers to the portion of a door latch strike which, upon closure of a door, is first contacted by a door latch and guides the latch to the aperture of the door latch strike.

The term "flexible material" as used herein refers to any material which can form the strike tongue and guide a door latch to an aperture in a base plate, but is also deformable and resilient such that upon contact by a person or an object being transported through the doorway, the strike tongue does not snag or interfere with either, thereby avoiding injury or damage and the strike tongue immediately returns to its original shape.

(II) Door Latch Strike

Typical door latch strikes comprising a base plate and a strike tongue are generally comprised solely of stamped metal materials coated with copper, nickel or another attractive finish. The strike tongue, which generally extends outwardly from the door jamb, can cause serious injury both to adults and children, including scrapes, bruises and cuts, as they pass by and make contact with the metal strike tongue. In addition, the metal strike tongue can also result in a tear to clothing and unwanted scratches or gouges in furniture as the metal tongue snags objects as they pass through a doorway.

The present disclosure relates to a flexible door latch strike. In one embodiment, the flexible door latch strike comprises a base plate and a strike tongue, wherein the strike tongue comprises a flexible material. In one embodiment, the flexible material comprising the strike tongue is able to guide a door latch to an aperture on the base plate, but is also deformable such that it reduces the likelihood of injury, and also reduces the likelihood of objects, such as clothing, furniture, being snagged on the strike tongue. In one embodiment, the door latch strike is a safety door strike which reduces or prevents injury as a result of the flexible strike tongue.

In one embodiment of the disclosure, there is included a door latch strike, comprising:

i) a base plate having an aperture for receiving a door latch, the base plate adapted to be attached to a door-jamb; and ii) a strike tongue extending outwardly from the base plate and adapted to guide the door latch to the aperture, wherein the strike tongue comprises a flexible material.

In one embodiment, the base plate comprises at least one opening for receiving a fastener to secure the base plate to the door jamb. In another embodiment, the base plate comprises a first and second opening. In a further embodiment, the first opening is located above the aperture and the second opening is located below the aperture. In one embodiment, a fastener, such as a screw or nail, passes through the first and/or second openings to fasten the door strike to a door jamb.

In other embodiments, the door latch strike is fastened to the door jamb by any means which secures the door latch strike to the door jamb, such as gluing the door latch strike to the door jamb, or welding the door latch strike to the door jamb.

In another embodiment, the base plate is a metal plate, which may be optionally coated with copper, nickel or other attractive finishes.

In another embodiment of the disclosure, the strike tongue is curved away from the latch. In another embodiment, the strike tongue is curved away from the door latch so that the tip of the strike tongue does not interfere with the door latch when it first contacts the door latch strike.

In another embodiment of the disclosure, the thickness of the strike tongue becomes gradually thicker from the base plate to the edge or front of the strike tongue to buffer the force by the latch upon contact. Existing metal strike plates are generally approximately $1/16^{th}$ of an inch thick. In one embodiment, the strike plate of the present disclosure is of a similar thickness resulting in facile replacement of existing plates.

In another embodiment of the disclosure, the flexible material is any material which guides a door latch to the aperture on the base plate, and is deformable such that it reduces or prevents injury if a person or object contacts the outwardly extending strike tongue, and returns to its original shape after contact by the door latch, person or object. In one embodiment, the flexible material is a rubber or plastic, for example vulcanized rubber. In one embodiment, the plastic is a deformable plastic, which includes any polymer, for example, a thermoplastic polymer, which can be deformed, without fracturing, exhibiting cracks or thermally decomposing, and is sufficiently elastic to return to its original shape after deformation. In another embodiment, the flexible material is a thermoplastic polyurethane.

In another embodiment, the strike tongue comprises a rubber portion. In another embodiment, the strike tongue comprises a plastic portion. In another embodiment of the disclosure, strike tongue comprises a flexible material which has a low coefficient of friction, such that the door latch easily glides across the strike tongue to the aperture of the base plate. In another embodiment, the flexible material is coated with a material having a low coefficient of friction, such as a polymer.

In another embodiment of the disclosure, the base plate and the strike tongue both comprise a flexible material, which may be the same or different.

In another embodiment, the flexible strike tongue is attached to the base plate by any mechanical or chemical means, for example, by gluing (or using any other adhesive substance, such as epoxy, polyurethane, etc.) the strike tongue to the base plate. In another embodiment, the strike tongue is fastened by nails and/or screw.

In one embodiment, the attachment means of the base plate and strike tongue may or may not be permanent but may allow for the removal and replacement of either the base plate or strike tongue areas without changing the other.

Referring to the drawings, it is seen that the door latch strike of the present disclosure, generally denoted by reference numeral 10, is comprised of a base plate 12, which has an aperture 14, and a strike tongue 16.

Figure 2:
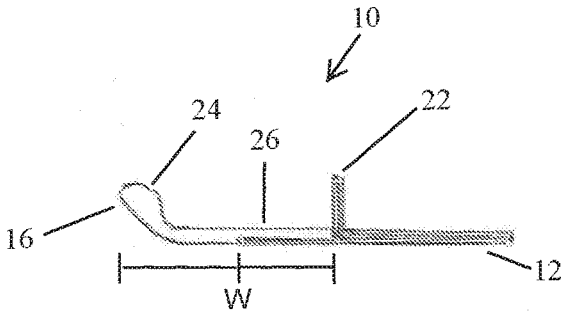
FIG. 2 is a top plan view of a door strike in one embodiment of the disclosure.
Figure 3:
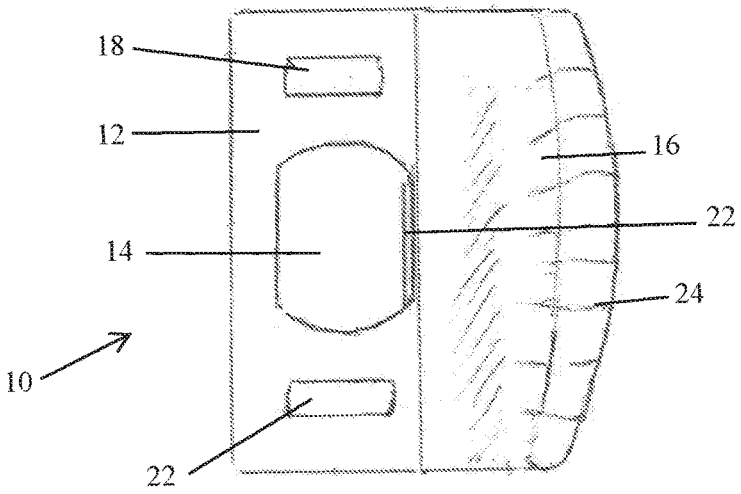
FIG. 3 is a rear elevation view of a door strike in one embodiment of the disclosure.

In one embodiment, as shown in FIGS. 1-3, the door strike is comprised of two separate sections, the base plate 12 and the strike tongue 16, which are attached together by appropriate means. In other embodiments, the base plate and strike tongue are comprised of the same material resulting in a single contiguous strike plate with flexible tongue FIG. 1 defines a height H of the strike tongue, while FIG. 2 defines a width W of the strike tongue. In this embodiment, the width W extends outwardly from the overlapping region 26.

In one embodiment, the latch strike as seen in FIG. 1 is secured to a door jamb by passing a screw through each of the upper 18 and lower 20 channels, located above and below the aperture 14 in the base plate 12. In this embodiment, the screw or nail openings are not single holes but rather elongated openings to accommodate the possible shifting of the flexible door latch strike, as may be required, to ensure a proper fit into the footprint in the door jamb. Alternatively, the flexible door latch strike may not have upper and lower channels 18 and 20, as the door latch strike may be attached to the door jamb with glue or other adhesive means. In another embodiment, the upper and lower channels 18 and 20 may be circular openings to allow passage of a screw or nail. The depending lip 22 extends inward from the aperture 14 of the flexible door strike latch 10, to help secure the strike in the aperture in the door jamb and also assist in securing the door latch within the strike aperture itself.

FIG. 2 is a top plan view of a flexible door latch strike 10, having a base plate 12, a flexible strike tongue 16, a depending lip 22, and a tongue buffer 24, the tongue buffer 24 providing additional support to the strike tongue 16 upon contact with the door latch. Overlap area 26 shows the overlap and attachment of the base plate to the flexible strike tongue.

FIG. 3 shows the rear elevation view of a flexible door latch strike 10, the elongated channels 18 and 20 to attach the flexible door latch strike to the door jamb, the aperture 14, the depending lip 22. In addition, FIG. 3 shows a rear view of the tongue buffer 24, an extension of the tongue material into a roll curled behind the front of the tongue. The tongue buffer supports and cushions the tongue from the force of the door latch when it impacts the soft latch strike area thus providing a smooth transition for the door latch on its path to the aperture.

Figure 4:
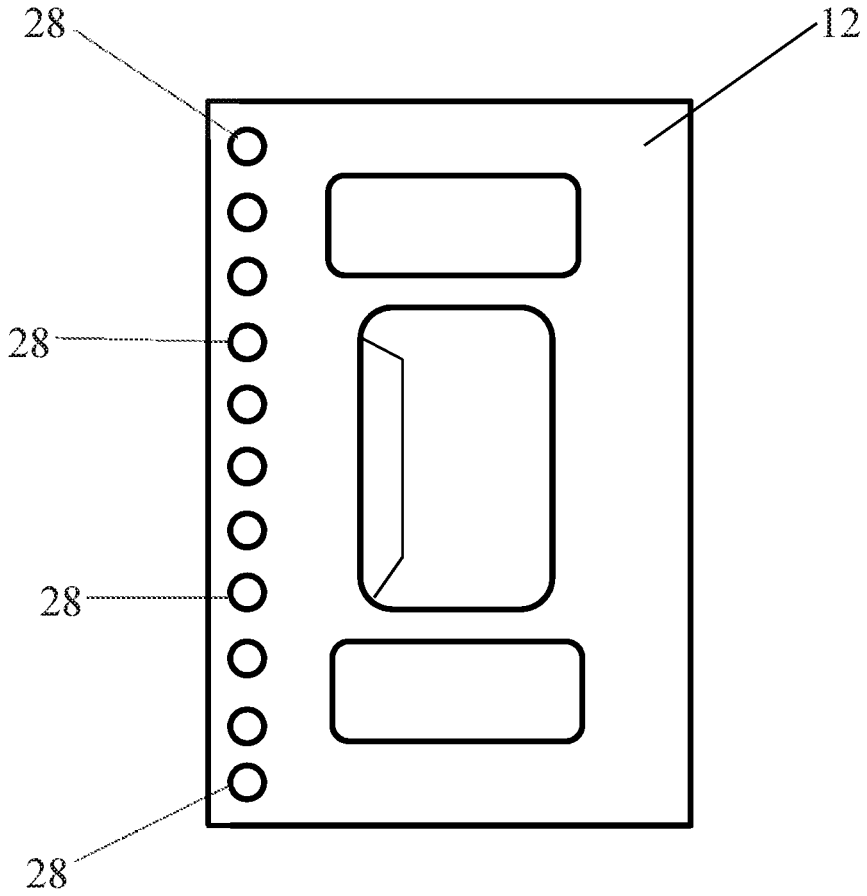
FIG. 4 is a front elevation view of a base plate in one embodiment of the disclosure.

FIG. 4 shows a front elevation view of a base plate 10, for example a metal base plate optionally with a finishing coat, having a plurality of holes 28 bored through the plate. In one embodiment, holes 28 are used in the manufacturing of the strike plate of the present disclosure, in which a moldable flexible material is bonded to the base plate by coating both sides of the base plate from the depending lip forward, while simultaneously flowing through the holes to bind with the base plate and forming the flexible tongue of the door strike. Depending on the nature of the flexible material, in one embodiment, the flexible material is heated during the manufacturing process such that it is able to flow and form the flexible strike tongue (for example, a rubber). In another embodiment, the flexible material during the manufacturing process is an uncured polymer, such as an uncured thermoplastic urethane, and after contacting with the base plate is cured to form the strike tongue of the flexible door strike.

The following non-limiting examples are illustrative of the present disclosure:

EXAMPLES

Example 1: Flexible Door Strike

A metallic base plate having dimensions of approximately 2¼" (length) by 1 6/16" (width) by 1/16" (depth), with an aperture of 1" by ⅝" was obtained. A flexible strike tongue was securely fastened with glue to the metallic base plate. The resulting flexible door strike had similar dimensions to common metallic door strikes.

The flexible door strike was then attached to a door jamb, and a door, having a door latch was closed as per standard procedure. The flexible tongue guided the door latch to the aperture of the base plate.

All publications, patents and patent applications are herein incorporated by reference in their entirety to the same extent as if each individual publication, patent or patent application was specifically and individually indicated to be incorporated by reference in its entirety. Where a term in the present application is found to be defined differently in a document incorporated herein by reference, the definition provided herein is to serve as the definition for the term.

Although the disclosure has been described in conjunction with specific embodiments thereof, if is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available as prior art to the present disclosure.

The invention claimed is:

1. A door strike, comprising:

i) a metal base plate having an aperture for receiving a door latch and defining a mounting surface, the base plate adapted to be attached to a door jamb; and ii) a strike tongue having first and second ends, the first end defines a length aligned with an axis of a door about which the door rotates and a width perpendicular to the length, the second end is configured to contact and guide the door latch to the aperture;

wherein the whole length and width of the first and second ends of the strike tongue is made of a flexible and elastic non-metallic material, wherein the first end of the strike tongue is configured to be bonded to the mounting surface of the base plate.

2. The door strike according to claim 1, wherein the base plate comprises at least one opening for receiving a fastener to secure the base plate to the door jamb.

3. The door strike according to claim 1, wherein the base plate comprises a first opening and a second opening for receiving a fastener to secure the base plate to the door jamb.

4. The door strike according to claim 3, wherein the first opening is located above the aperture and the second opening is located below the aperture.

5. The door strike according to claim 3, wherein the first opening and the second opening are channels located above and below the aperture, respectively.

6. The door strike according to claim 1, wherein the strike tongue is curved away from the door latch.

7. The door strike according to claim 1, wherein the strike tongue comprises a rubber portion.

8. The door strike according to claim 1, wherein the strike tongue comprises a plastic portion.

9. The door strike according to claim 1, wherein the flexible material comprises rubber or plastic.

10. The door strike according to claim 1, wherein the flexible material has a low coefficient of friction.

11. The door strike according to claim 1, wherein the flexible material is coated with a material having a low coefficient of friction.

12. The door strike according to claim 11, wherein the material having a low coefficient of friction is a polymer.

13. The door strike according to claim 1, wherein the flexible material is a thermoplastic polyurethane.

14. The door strike according to claim 1, wherein the base plate further comprises a depending lip extending inward from the aperture.

15. The door strike according to claim 1, wherein the first end of the strike tongue is bonded to the mounting surface by adhesive or melting.

* * * * *